US011268258B2

(12) United States Patent
Kovalick et al.

(10) Patent No.: US 11,268,258 B2
(45) Date of Patent: Mar. 8, 2022

(54) EXTENDABLE SCARIFIER SYSTEM

(71) Applicant: Caterpillar Inc., Peoria, IL (US)

(72) Inventors: Benjamin J. Kovalick, Decatur, IL (US); Rena J. Kanegae, Aurora, IL (US); David L. Cox, Monticello, IL (US); Nathan G. Tissier, Champaign, IL (US); Nathaniel K. Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 109 days.

(21) Appl. No.: 16/752,800

(22) Filed: Jan. 27, 2020

(65) Prior Publication Data

US 2021/0230830 A1 Jul. 29, 2021

(51) Int. Cl.
*E02F 3/76* (2006.01)

(52) U.S. Cl.
CPC ..... *E02F 3/7604* (2013.01)

(58) Field of Classification Search
CPC ..... E02F 3/8155; E02F 3/8152; E02F 3/815; E02F 3/764; E02F 3/844; E02F 3/7645; E02F 3/76; E02F 3/7604; A01B 63/00
See application file for complete search history.

(56) References Cited

U.S. PATENT DOCUMENTS 512,573 A * 1/1894 Ayre ..... A01B 69/024 172/132
1,999,226 A * 4/1935 Wold ..... E02F 3/7636 172/785
2,354,560 A * 7/1944 Troup ..... E02F 3/7604 37/380
2,573,977 A * 11/1951 Lindgren ..... E02F 3/7604 172/677
2,686,982 A * 8/1954 Leliter ..... E02F 3/7636 172/784
3,327,413 A * 6/1967 Brinkmeyer ..... E02F 3/7604 172/785
5,411,102 A * 5/1995 Nickels ..... A01B 59/044 172/247
6,904,979 B1 * 6/2005 Confoey ..... E02F 3/7604 172/799.5
2002/0144828 A1 * 10/2002 Keigley ..... A01B 31/00 172/197
2008/0000653 A1 * 1/2008 Schwartz ..... E02F 3/7663 172/198

(Continued)

FOREIGN PATENT DOCUMENTS

CN 203346934 U 12/2013
CN 104372813 A 2/2015

(Continued)

*Primary Examiner* — Jessica H Lutz
(74) *Attorney, Agent, or Firm* — Leydig, Voit & Mayer, Ltd.

(57) ABSTRACT

A motor grader includes a frame and an extendable scarifier system supported on the frame. The scarifier system includes first and second drawbar arms coupled to the frame. A carriage is coupled to the first and second drawbar arms. The carriage includes a carriage body having first and second lateral ends. A first extension element is attached to the first lateral end of the carriage body and a second extension element is attached to the second lateral end of the carriage body. The first and second extension elements each supporting at least one tooth.

15 Claims, 3 Drawing Sheets

(56) References Cited

U.S. PATENT DOCUMENTS

2018/0106014 A1* 4/2018 Horstman ..... E02F 9/2037

FOREIGN PATENT DOCUMENTS

| | | | |
|---|---|---|---|
| CN | 204185890 | U | 3/2015 |
| CN | 105874929 | A | 8/2016 |
| CN | 206015749 | U | 3/2017 |
| CN | 206625267 | U | 11/2017 |

* cited by examiner

EXTENDABLE SCARIFIER SYSTEM

TECHNICAL FIELD

This disclosure relates generally to a scarifier system for a motor grader and, more particularly, to a scarifier system for a motor grader that provides increased versatility and visibility to an operator.

BACKGROUND

Motor graders can be used to prepare the grade of a ground surface in an area. Grading can be provided for numerous reasons, including for roads, providing foundation, and the like where a uniform surface is desired for an end application. Motor graders generally are elongated vehicles that include multiple implements for performing such tasks.

Implements can include grader blade systems such as drawbar, circle mount, and moldboard (DCM) systems, dozer blade systems, scarifier systems, and the like. These implements are mounted to the motor grader frame for utilization as required. Mounting locations include, but are not limited to, a front mounting position, mid-mounting position, and back mounting position. The front mounting position of an implement is in the front of the frame, and specifically, where the implement extends in front of front wheels of the motor grader. This mounting position is typically for dozer blade systems. Similarly, the back-mounting position is at the back end of the frame and can include the ripper system and scarifier system. Mid-frame mounting, or mid-mount implements are positioned between the front end and back end of the motor grader. Typical implements having a mid-mount include the DCM system and scarifier system.

One of the main challenges for mid-mounted implements, such as scarifier systems, is visibility for the operator. With a mid-mount scarifier system the operator's view of the scarifier can be obstructed by other systems including the frame, hydraulic systems, other implement systems, and the like. For example, many motor graders mid-mount both the DCM system and scarifier system between the cab of the motor grader and front wheels with the DCM system being arranged in a position between the cab and the scarifier system. These obstructions can make it difficult for an operator in the cab to see the scarifier system which can make operation of the motor grader more difficult. Scarifier systems can be configured with a straight block or a V-shaped body. Operator visibility can be a particular issue with scarifier systems having a V-shaped body as they are typically narrower than straight body systems.

Another issue with some mid-mount scarifier systems is that they can have a limited reach which can lead to complications in certain applications. For example, a scarifier system can be used like a garden rake to spread a windrow of material laid down by, for example, a dump truck in a road grading application. The scarifier system desirably can be used to spread the material close to the curb before finish blading is applied. Scarifier systems with a more limited reach may require the motor grader to make extra passes, which can be more time-consuming. Additionally, in some cases, the operator may drive the motor grader over a new curb in order to spread the material to the curb edge which could damage the fresh concrete of the new curb.

A moldboard blade for a motor grader that has an adjustable width is disclosed in CN206015749U. The width-adjustable moldboard blade fails to address the issues associated with visibility of the scarifier system and may make the scarifier system even more difficult for an operator to see. The disclosed width-adjustable moldboard blade also does not address the issues associated with the limited reach of some scarifier systems.

SUMMARY

In one aspect, the disclosure describes a motor grader that includes a frame having a front end and a rear end and an extendable scarifier system supported on the frame. The extendable scarifier system includes first and second drawbar arms coupled to the frame and a carriage coupled to the first and second drawbar arms. The carriage includes a carriage body having a leading edge closest to the front end of the frame, a trailing edge closest to a rear end of the frame and first and second lateral ends. A first extension element is attached to the first lateral end of the carriage body and a second extension element is attached to the second lateral end of the carriage body. The first and second extension elements each support at least one tooth.

In another aspect, the disclosure describes an extendable scarifier system. The scarifier system includes first and second drawbar arms and a carriage coupled to the first and second drawbar arms. The carriage includes a carriage body supporting a plurality of teeth and having a leading edge, a trailing edge and first and second lateral ends. A first extension element is attached to the first lateral end of the carriage body and a second extension element is attached to the second lateral end of the carriage body. The first and second extension elements each support at least one tooth.

In yet another aspect, the disclosure describes a system for extending a carriage body of a scarifier system. The carriage body having a leading edge, a trailing edge, a first lateral end and a second lateral end. The system includes a first extension element attached to the first lateral end of the carriage body and a second extension element attached to the second lateral end of the carriage body. The first and second extension elements each support at least one tooth.

DETAILED DESCRIPTION

Figure 1:
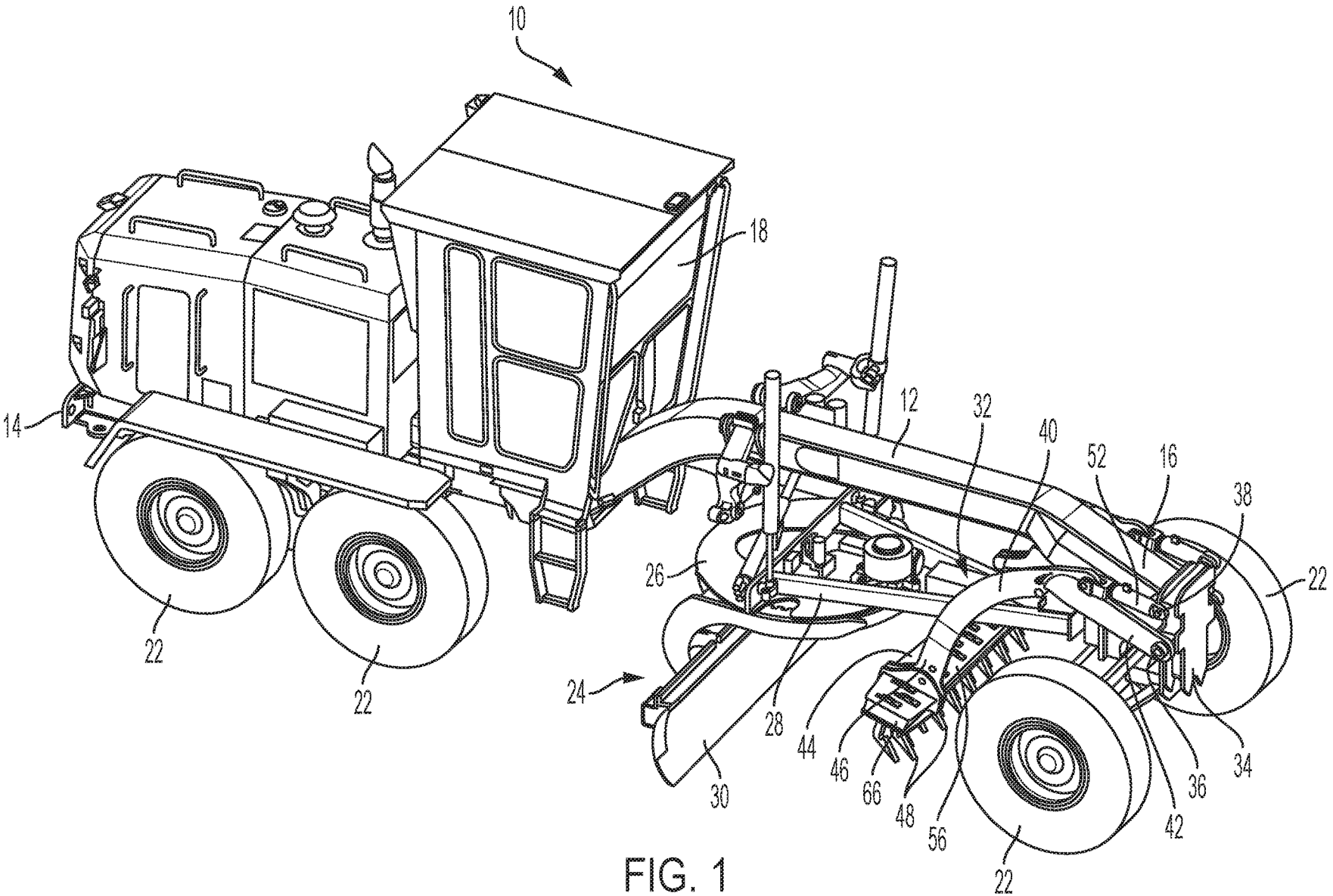
FIG. 1 is a perspective view of an illustrative motor grader having an exemplary scarifier system.

This disclosure relates to a scarifier system for a motor grader. Now referring to the drawings, FIG. 1 illustrates portions of an exemplary motor grader 10. The illustrated motor grader 10 includes a frame 12 that extends from a rear end 14 to front end 16. At the back end, the frame 12 holds the engine, hydraulics, and the like for operating different systems and assemblies of the motor grader 10. The frame 12 in one example supports a cab 18 that can include a control system for operation by an operator within the cab 18 of the different operating systems and assemblies. Such operating systems and assemblies include, but are not limited to hydraulic systems, vehicle propelling, vehicle steering, implement controls, and the like. The frame 12, in this case, also has a plurality of wheels 22, including at the back and front ends. Based on the length of the frame, the motor grader 10 can have additional wheels as desired to support the frame 12.

In the illustrated embodiment, a drawbar, circle, and moldboard (DCM) system 24 is coupled to the frame 12. The DCM system 24 can include a circle frame 26, support frame 28, and moldboard or blade 30. The support frame 28 in one example has a generally A-shape tapering inwardly from one end coupled to the circle frame 26 to another end coupled to the frame 12 of the motor grader 10 adjacent the front wheels 22. In other examples the support frame includes other shapes, including being generally Y-shaped.

Figure 2:
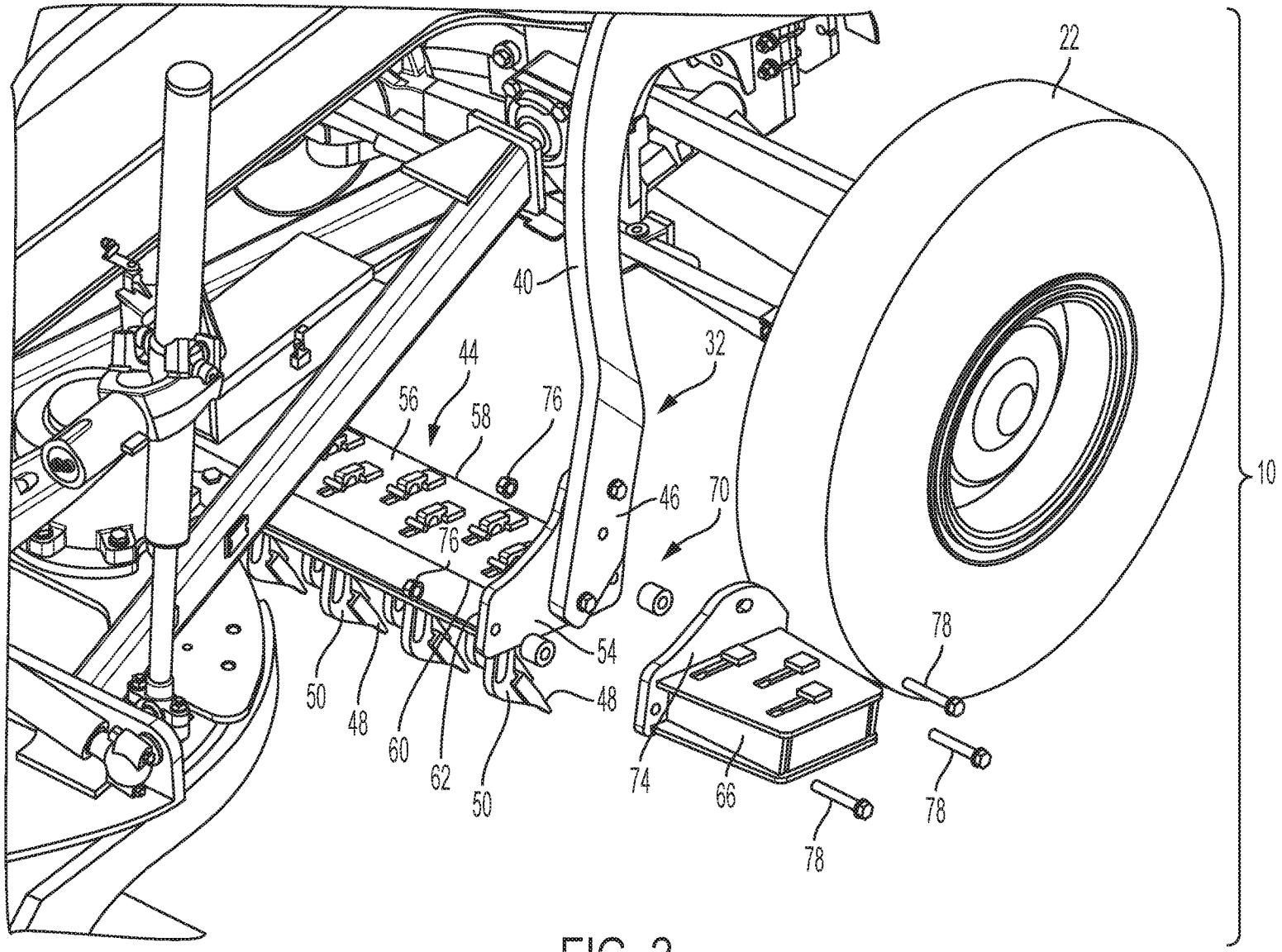
FIG. 2 is an enlarged, perspective view of a portion of the motor grader of FIG. 1 showing the scarifier system of FIG. 1 partially exploded.

A scarifier system 32 is also coupled to the frame 12 in a mid-mount position, forward of cab 18 and the blade 30 of the DCM system 24. In this case, the scarifier system 32 includes a plate element 34 coupled to the front end of the frame 12 of the motor grader 10. At the front end, the plate element 34 receives first and second pin members 36 and 38 that are aligned and positioned in parallel spaced relation to one another. The scarifier system 32 also can include, for example, arcuate drawbar arms 40 that are spaced from one another on each side of the frame such that the frame 12 of the motor grader 10 is between the arms 40. Each drawbar arm 40 in one example is pivotably coupled to the first pin member 36 coupled to the plate element 34. Each drawbar arm 40 extends from the first pin member 36 at a first end 42 to a carriage 44 mounted between each drawbar arm 40 at a second end 46. As discussed in greater detail below and as best shown in FIG. 2, the carriage 44 includes a plurality of teeth 48, which for example may be attached to shanks 50, for engaging the ground in a working position.

Additionally, for effecting movement of the drawbar arms 40, at least one actuator 52 can be coupled to a drawbar arm 40. In one example, two actuators 52 extend generally horizontal to the ground and in spaced relation on either side of the frame 12 such that the frame 12 is between the actuators 52 as shown in FIG. 1. In an example, the actuators 52 are hydraulic actuators such as hydraulic cylinders coupled to the hydraulic system of the motor grader 10 that hydraulically actuate the actuators 52. Alternatively, in another example a motor mechanically actuates the actuators 52. The actuators 52 are coupled between the second pin member 38 and the drawbar arms 40 such that extension and retraction of the actuators 52 move the drawbar arms 40 to rotate the carriage from a working position to a non-working position about a pivot axis of the first pin member 36. In this way, an operator may control the height of the carriage 44 from the cab of the motor grader.

The carriage 44 may be coupled to the second end 46 of the drawbar arms 40 in any manner. For example, in the illustrated embodiment as shown in FIG. 2, the coupling can occur with drawbar coupling plates 54 of the drawbar arms 40 or carriage 44 that secure side surfaces of the carriage 44 to the drawbar arms 40, or any combination of surfaces. The carriage 44 may also include a carriage body 56 that, in one example, couples to a plurality of shanks 50 that each couple to a tooth 48. The teeth 48 generally extend into a point that engages the ground to dig into and break up and ground when the carriage 44 is in an operational position. In the embodiment illustrated in FIGS. 1-3, the carriage body 56 has a substantially straight configuration with the carriage body 56 generally having a rectangular shape. Alternatively, the carriage body 56 may have other configurations. For example, the carriage body 56 illustrated in FIG. 4 has a V-shaped configuration. With either illustrated configuration, the carriage body 56 has a leading edge 58 (i.e., the edge closest to the front end 16 of the frame 12 of the motor grader 10), a trailing edge 60 (i.e., the edge closest to the rear end 14 of the frame 12) and first and second lateral ends 62, 64.

Figure 3:
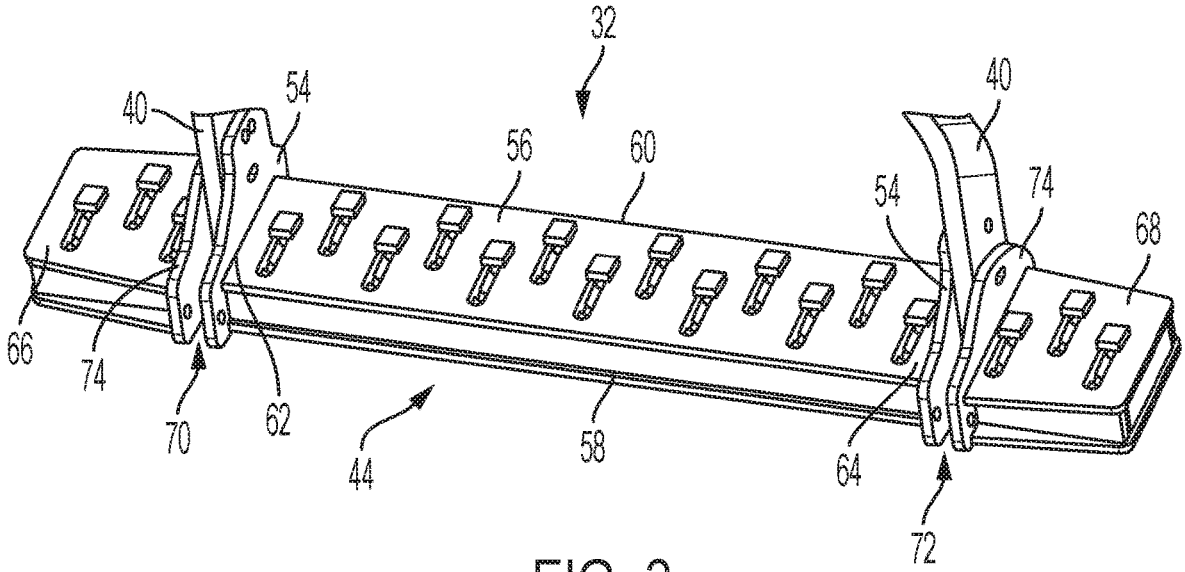
FIG. 3 is a perspective view of a portion of the scarifier system of FIGS. 1 and 2.
Figure 4:
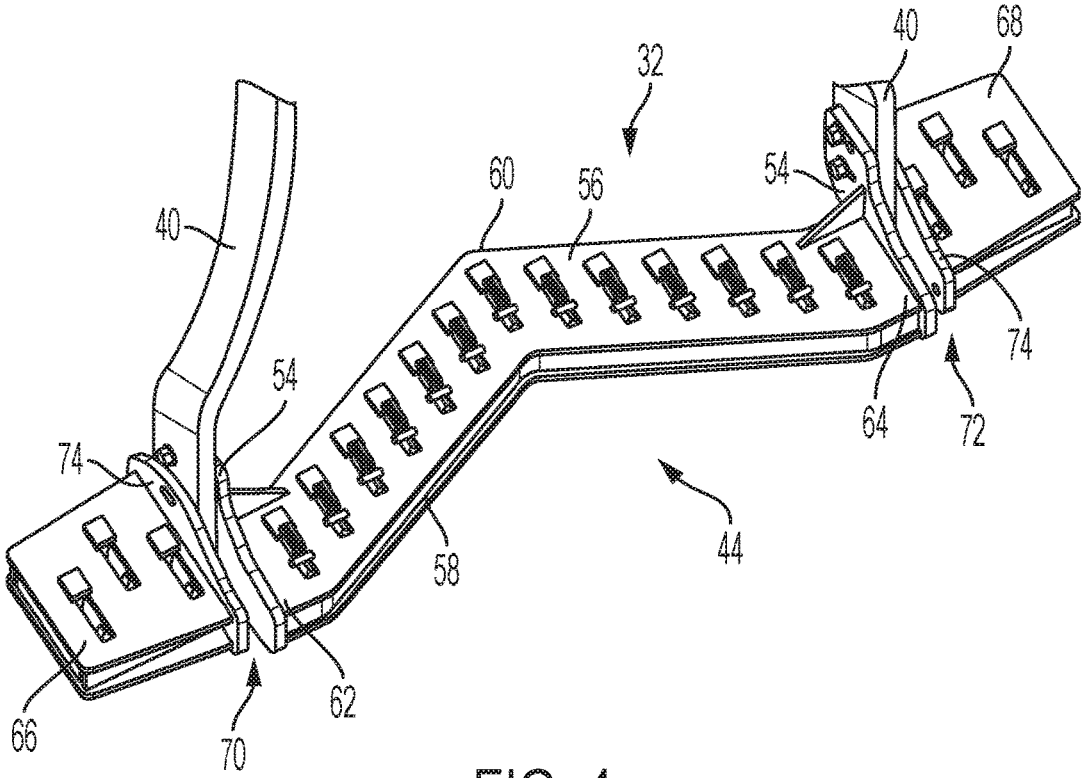
FIG. 4 is perspective view of a portion of an alternative embodiment of a scarifier system.

To allow the carriage body 56 to be scalable for different applications, the carriage body 56 may be configured with attached extension elements on the first and second lateral ends 62, 64 thereof. More particularly, as shown in FIGS. 3 and 4, first and second extension elements 66, 68 each of which support one or more teeth 48 are attached respectively to the first and second lateral ends 62, 64 of the carriage body 56. In the illustrated embodiment, each of the first and second extension elements 66, 68 include three teeth 48 which are coupled to shanks 50 which are, in turn, coupled to the respective extension element. Other numbers of teeth 48 as well as different methods for supporting the teeth 48 may be used. In one example, each of the first and second extension elements 66, 68 may be sized such that when attached to the carriage body 56 the extension elements extend substantially to the outer edge of the wheels 22 of the motor grader 10 such as shown in FIG. 1. It will of course be appreciated that the first and second extension elements 66, 68 may have different sizes and configurations depending, for example, on the equipment with which they will be used and/or application in which they are to be used.

For securing the first and second extension elements 66, 68 to the first and second lateral ends 62, 64 of the carriage body 56, first and second fastening systems 70, 72 may be provided for respectively the first and second extension elements 66, 68. In the illustrated embodiment, as best shown in FIG. 2, each of the first and second fastening systems 70, 72 includes, an extension coupling plate 74 on an inner edge of the respective one of the first and second extension elements 66, 68 that is configured for attachment to the drawbar coupling plate 54 on the side of the carriage body 56 to which the extension element is attached. In one example shown in FIG. 2, the extension coupling plate 74 is secured to the drawbar coupling plate 54 by removable fasteners, in this case nuts 76 and bolts 78. In other embodiments, different fastening systems may be used including, for example, welds. The first and second extension elements 66, 68 may be provided for attachment to a specific scarifier system 32 or they may be retrofit onto existing scarifier systems 32.

INDUSTRIAL APPLICABILITY

The disclosed extendable scarifier system 32 may be used in any application where it is desired to increase the visibility or versatility of the scarifier carriage 44. More specifically, the disclosure may be particularly relevant to applications in which an operator may desire being able to see at least a portion of the scarifier carriage 44 during operation of the motor grader 10. For example, other assemblies and systems of a motor grader can make it difficult for an operator to observe the scarifier carriage 44. The disclosed first and second extension elements 66, 68 allow the scarifier carriage 44 to extend outboard of these other assemblies and systems which eliminates line of site issues for motor grader operators.

Additionally, attaching the first and second extension elements 66, 68 to the scarifier carriage 44 increases the overall width of the scarifier carriage 44 which may be advantageous in certain applications. For example, the increased width of the scarifier carriage 44 may eliminate the need for time-consuming extra passes of the motor grader 10 to sufficiently spread material or disrupt the ground. Moreover, sizing the first and second extension elements 66, 68 such that they extend to close to the outer edge of the wheels 22 can allow material to be spread material or disrupt the ground closer to, for example, a curb during a road grading operation and thereby eliminate the need for the motor grader to be driven up on the curb to reach the area adjacent to the curb with the scarifier teeth 48.

It will be apparent to those skilled in the art that various modifications and variations can be made to the disclosed motor grader 10 and scarifier systems 32 and extension elements 66, 68 without departing from the scope of the disclosure. Other embodiments of the motor grader 10, scarifier systems 32 and extension elements 66, 68 will be apparent to those skilled in the art from consideration of the specification and practice of the methods disclosed herein. It is intended that the specification and examples be considered as exemplary only, with a true scope of the disclosure being indicated by the following claims and their equivalents.

This disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A motor grader comprising:

a frame having a front end and a rear end;

an extendable scarifier system supported on the frame comprising:

first and second drawbar arms pivotably connected to the frame at respective first and second pivot points;

a carriage having a first lateral end coupled to the first drawbar arm and a second lateral end coupled to the second drawbar arm, the carriage including a carriage body having a leading edge closest to the front end of the frame and a trailing edge closest to a rear end of the frame; and a first extension element attached to and laterally spaced from the first lateral end of the carriage body to accommodate the coupling of the first drawbar arm to the first lateral end of the carriage body and a second extension element attached to and laterally spaced from the second lateral end of the carriage body to accommodate the coupling of the second drawbar arm to the second lateral end of the carriage body, the first and second extension elements each supporting at least one tooth; and an actuator pivotably coupled to the frame and coupled to one of the first and second drawbar arms for rotating the drawbar arms about a pivot axis defined by the first and second pivot points so as to move the carriage between a working position and a non-working position.

2. The motor grader of claim 1 wherein the carriage body has a substantially straight configuration.

3. The motor grader of claim 1 wherein the carriage body has a substantially V-shaped configuration.

4. The motor grader of claim 1 wherein the at least one tooth supported by each of the first and second extension elements is one of a plurality of teeth supported by the respective one of the first and second extension elements.

5. The motor grader of claim 1 wherein the scarifier system further includes a first attachment system attaching the first extension element to the first lateral end of the carriage body and a second attachment system attaching the second extension element to the second lateral end of the carriage body.

6. The motor grader of claim 5 wherein each of the first and second attachment systems includes removable fasteners that secure the first and second extension elements to respectively the first and second lateral ends of the carriage body.

7. The motor grader of claim 6 wherein each of the first and second attachment systems includes an extension coupling plate carried on an inner edge of each of the first and second extension elements and a drawbar coupling plate attached to the respective one of the first and second lateral ends of the carriage body.

8. The motor grader of claim 1 wherein the frame includes wheels and the first and second extension elements extend near an outer edge of at least one of the wheels.

9. An extendable scarifier system comprising:

first and second drawbar arms that are pivotable about respective first and second pivot points;

a carriage having a first lateral end coupled to the first drawbar arm and a second lateral end couple to the second drawbar arm, the carriage including a carriage body supporting a plurality of teeth and having a leading edge and a trailing edge;

a first extension element attached to and laterally spaced from the first lateral end of the carriage body to accommodate the coupling of the first drawbar arm to the first lateral end of the carriage and a second extension element attached to and laterally spaced from the second lateral end of the carriage body to accommodate the coupling of the second drawbar arm to the second lateral end of the carriage, the first and second extension elements each supporting at least one tooth; and an actuator coupled to one of the first and second drawbar arms for rotating the drawbar arms about a pivot axis defined by the first and second pivot points so as to move the carriage between a working position and a non-working position.

10. The extendable scarifier system of claim 9 wherein the carriage body has a substantially straight configuration.

11. The extendable scarifier system of claim 9 wherein the carriage body has a substantially V-shaped configuration.

12. The extendable scarifier system of claim 9 wherein the at least one tooth supported by each of the first and second extension elements is one of a plurality of teeth supported by the respective one of the first and second extension elements.

13. The extendable scarifier system of claim 9 wherein the scarifier system further includes a first attachment system attaching the first extension element to the first lateral end of the carriage body and a second attachment system attaching the second extension element to the second lateral end of the carriage body.

14. The extendable scarifier system of claim 13 wherein each of the first and second attachment systems includes removable fasteners that secure the first and second extension elements to respectively the first and second lateral ends of the carriage body.

15. The extendable scarifier system of claim 14 wherein each of the first and second attachment systems includes an extension coupling plate carried on an inner edge of each of the first and second extension elements and a drawbar coupling plate attached to the respective one of the first and second lateral ends of the carriage body.

* * * * *